United States Patent [19]

Mason

[11] 4,058,921

[45] Nov. 22, 1977

[54] PISTOL ADAPTED FOR DISPENSING DEBILITATING CHEMICAL REPELLANTS

[76] Inventor: Neil E. Mason, 36004 Salisbury Drive, Newark, Calif. 94560

[21] Appl. No.: 761,104

[22] Filed: Jan. 21, 1977

[51] Int. Cl.[2] ..... F41C 27/00

[52] U.S. Cl. ..... 42/1 G; 222/79

[58] Field of Search ..... 42/1 G, 1 H, 1 J; 222/79

[56] References Cited

FOREIGN PATENT DOCUMENTS 118,813 9/1918 United Kingdom ..... 42/1 G

*Primary Examiner*—Stanley H. Tollberg
*Assistant Examiner*—Hadd Lane
*Attorney, Agent, or Firm*—Townsend and Townsend

[57] ABSTRACT

A handheld firearm such as a standard revolver is adapted to dispense a debilitating chemical substance through the butt end. Accordingly, modification in the hollow shank of a revolver between the paired wooden grips has mounted therein a small cannister of a debilitating chemical, such as Chemical Mace or teargas, under pressure. The cannister includes a valve and a nozzle at the open end which points through an aperture in the butt end of the shank and is reciprocally movable towards and away from the aperture in the shank. The grip is modified with an aperture which is recessed from the normal handling surface of the weapon. The recessed aperture is positioned under preferably the second or third finger and may be actuated by the digit moving inwardly to depress a reciprocating spring-loaded button in the indentation. Upon depression of the button, the cannister is moved towards the butt end to operate the nozzle causing the chemical to be discharged. In use, the particular combination recited enables the gun barrel to be in the upward and ostensibly "safe" position while permitting discharge of chemicals through the butt end of the weapon.

9 Claims, 2 Drawing Figures

PISTOL ADAPTED FOR DISPENSING DEBILITATING CHEMICAL REPELLANTS

BACKGROUND OF THE INVENTION

The present invention relates to protection devices. Particularly, the present invention relates to the addition of a facility to dispense a debilitating chemical to a standard revolver.

Peace officers are often equipped with a variety of devices for controlling law violators under emergency conditions. The officer's arsenal primarily includes a firearm, such as a standard revolver or pistol. Firearms, however, are highly lethal, and severe restrictions are placed on their handling and use. Therefore, an officer often carries other less lethal devices, such as a billyclub or a Chemical Mace dispenser, to be employed as the situation may warrant.

In many emergency or action situations, it is difficult at the outset to know whether a lethal or non-lethal weapon would be most effective. It is cumbersome and impractical to approach such situtations with all possible weapons in hand. Nevertheless, circumstances in an action situation may change rapidly, calling for a different level or type of response in order to protect the officer and to avoid unnecessary harm to assailants and victims.

For example, an officer might enter a situation with a drawn firearm in a characteristic "safe" position, i.e., where the weapon is pointed upwardly, leaving one hand free to manipulate doors and the like. A change in the situation may require that a non-lethal chemical weapon be withdrawn quickly from its holster, aimed and directed at an assailant in the shortest possible time. Valuable time may be lost if the officer's hands are already occupied or the firearm must be laid aside to draw the chemical weapon.

As a further example, an officer may be caught off-guard, while holding his firearm in the normally safe position. Any abrupt movement by the officer invites countermeasures by his assailant. Therefore, the officer is essentially disarmed if he is caught off-guard.

BRIEF DESCRIPTION OF THE PRIOR ART

Combination non-lethal weapons are known to the art. For example, Wildes et al., U.S. Pat. No. 2,124,172 discloses a tear gas gun in combination with a policeman's billyclub. Such a device extends the effective control area beyond the reach of the user. Haskins, U.S. Pat. No. 3,841,526 describes fluid in the pointed direction of the pistol. The Haskins invention could be dangerous to the user, because it appears to be a lethal weapon. Any threatening use of the weapon would invite a lethal response by the opposer which could not be countered with this weapon.

Similarly, any deployment of a billyclub in combination with the tear gas gun of the Wilde et al. would invite prompt countermeasures by an opposer.

Disguised defensive weapons are known to the art. For example, U.S. Pat. No. 3,109,253 discloses a tear gas dispenser for defensive use disguised in the form of a harmless cigarette lighter. While such a device may find use in certain defensive situations involving ostensibly unarmed persons, it is of little or no use to a police officer in a typical action situation.

What is therefore needed is a versatile weapon suitable for use in a variety of police action situations which is capable of rapid, and if necessary, unexpected deployment under a variety of action situations calling for either a lethal or a non-lethal response.

SUMMARY OF THE INVENTION

A handheld firearm such as a standard revolver is adapted to dispense a debilitating chemical substance through the butt end. Accordingly, modification in the hollow shank of a revolver between the paired wooden grips has mounted therein a small cannister of a debilitating chemical, such as Chemical Mace or tear gas, which may be under pressure. The cannister includes a valve and a nozzle at the open end which points through an aperture in the butt end of the shank and is reciprocally movable towards and away from the aperture in the shank. The grip is modified with an aperture which is recessed from the normal handling surface of the weapon. The recessed aperture is positioned under preferably the second or third finger and may be actuated by the digit moving inward to depress a reciprocating spring-loaded button in the indentation. Upon depression of the button, the cannister is moved toward the butt end to operate the nozzle, causing the chemical to be discharged in the desired direction. In use, the particular combination recited enables the gun barrel to be in the upward and ostensibly "safe" position while permitting discharge of chemicals through the butt end of the weapon.

One object of the invention is to provide a dual-purpose weapon which can be deployed quickly in either a lethal or a non-lethal mode.

It is a further object of the invention to provide a modification to a lethal weapon such as a handgun to provide a dual-purpose weapon suitable for a variety of action situations.

It is a further object of the invention to provide a debilitating chemical spray dispenser in combination with a police service revolver for use in a variety of action situations. In particular, an object of the present invention is to provide a chemical repellant dispenser in combination with the police service revolver which can be discharged toward an assailant when the barrel of the service revolver is in an ostensibly safe position, and particularly without an overt or threatening movement. Thus, a police officer at a disadvantage to an assailant can discharge the non-lethal spray of chemical repellant toward the assailant in order to regain a tactical advantage.

Other objects and advantages of the present invention will be apparent upon reference to the following detailed description of specific embodiments together with the accompanying drawings.

DETAILED DESCRIPTION OF PREFERRED EMBODIMENTS

Figure 1:
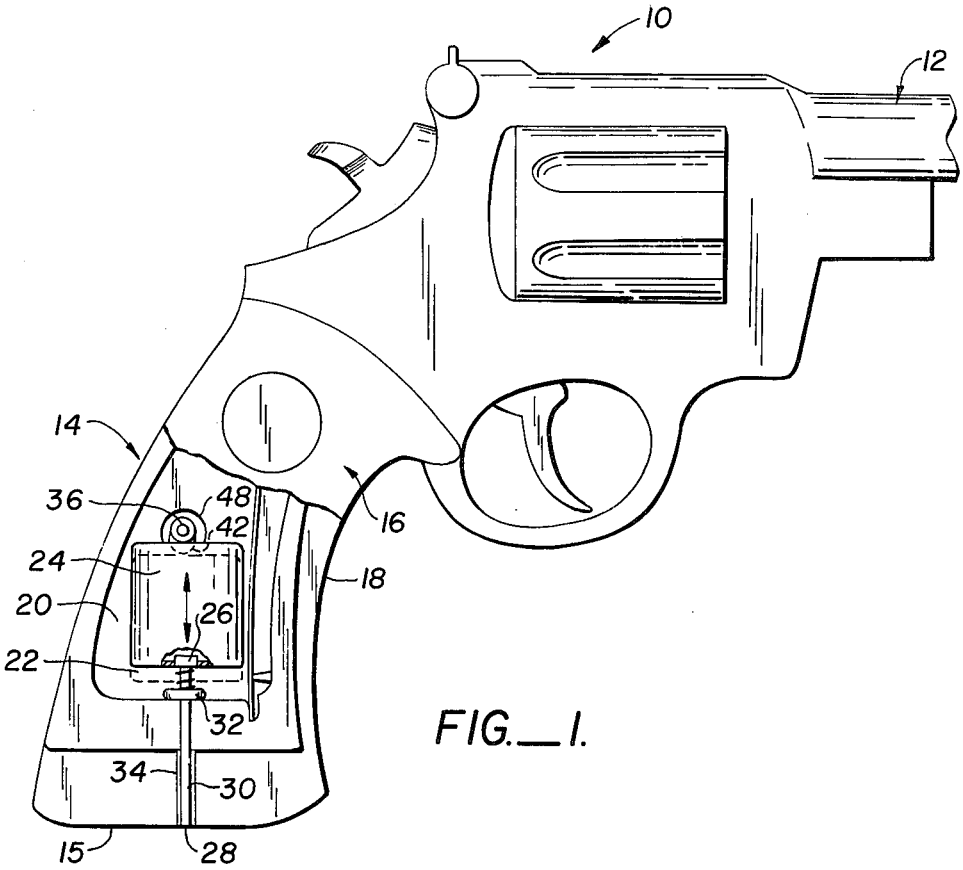
FIG. 1 is a sideview of a combination service revolver and debilitating chemical repellant dispenser, shown in partial cutaway.

In FIG. 1, a handheld firearm, such as a standard service revolver 10, is illustrated as modified according to the present invention. The revolver 10, which may be a Smith & Wesson Model 19 police revolver, includes a barrel 12 and a generally hollow shank 14, which forms part of a handle. Surrounding the shank 14 are paired wooden grips 16 and 18, which form therebetween within the shank 14 a hollow chamber 20.

Figure 2:
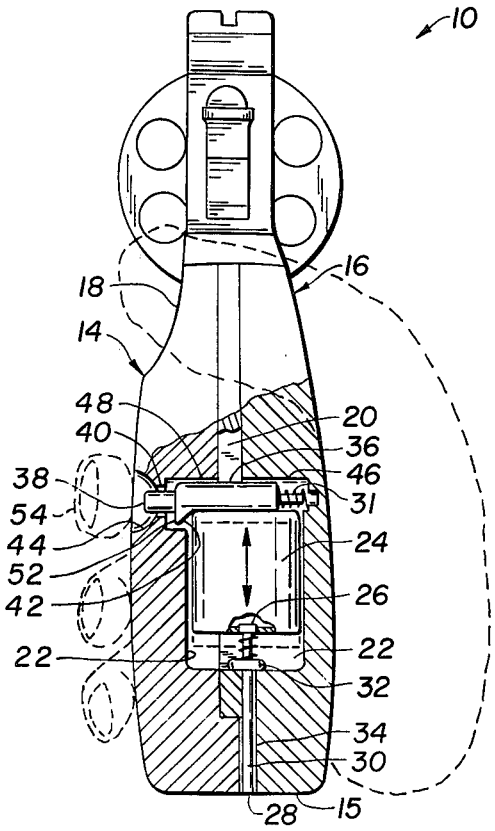
FIG. 2 is a vertical rear view of the combination weapon in partial cutaway.

A trough 22 is carved out of the interior surfaces of the wooden grips 16 and 18. The trough 22 is generally oriented in alignment facing the butt end 15 of shank 14. According to the invention, a cannister of a debilitating chemical substance under pressure, such as Chemical Mace, is mounted within the shank 14 in a manner which permits discharge of the debilitating chemical transverse of the barrel 12, i.e., from the butt end 15 of the revolver 10. FIGS. 1 and 2 illustrate the preferred embodiment of this invention.

Cannister 24 is seen to be mounted within the trough 22 to reciprocate between a first position and a second position. The cannister 24, which may be a straight cylindrical aerosol container adapted to fit within the hollow shank 14, includes a valve 26 for releasing the cannister 24 contents. At the butt end 15, a nozzle 28 is provided. The nozzle 28 is in fluid communication through a tube 30 to the valve 26 of cannister 24. The valve 26 is normally biased by a spring or the like to a closed position. Reciprocal movement of the tube 30 with respect to the cannister 24 causes the valve 26 to open, releasing the contents of cannister 24.

In order that the cannister 24 can reliably reciprocate with respect to the tube 30, means may be provided for holding the tube 30 stationary with respect to the shank 14. Such retention means may take the form of, for example, a stopper 32 pressed onto the tube 30, or it may take the form of some other means such as a friction fit between the tube 30 and the walls of shank 14.

In order to accommodate the tube 30, the butt end 15 is provided with a narrow passageway 34 between the hollow inner chamber 20 and the butt end 15. The passageway 34 may either be centered within the shank 14 or offset to pass through only one of the wooden grips 16 or 18.

Discharge of the cannister 24 is effected by an actuator 36. The actuator 36 comprises a shaft having an externally exposed button end 38, a shoulder and a tapered shank 42. The actuator is disposed within the shank 14 so as to be movable laterally transverse of the cannister 24. The button end 38 in the fully externally extended position is recessed within an external depression 44. Guideways 46 and 48 in the wooden grip 16 and 18 accommodate the reciprocal movement of actuator 36. The actuator 36 is biased by a coil spring 31 so that the shoulder 40 abuts a complementary surface or stop 52 to limit the motion of the actuator.

Because the button end 38 is recessed within depression 44 in its fully extended position, the actuator 36 is protected against inadvertent operation. For example, a finger or digit 54, such as the second or third finger, may normally rest above or behind the depressed aperture 44. Therefore, in order to operate the actuator, conscious pressure must be applied to the recessed button end 38.

In operation, a digit 54 depresses button end urging the actuator 36 laterally transverse of the chamber 20. The tapered shank 42 is thereby urged against an end margin of cannister 24, thus moving the cannister 24 reciprocally along trough 22. Finger pressure on the actuator 36 upon movement of the cannister 24 causes valve 26 to open, releasing the pressurized fluid within the cannister 24. The fluid is discharged through tube 30 at nozzle 28, directing a spray of repellant from the butt end 15 of the revolver 10, which may be pointed in any desired direction. Because the revolver 10 is normally in the up or ostensibly "safe" position, and the chemical weapon of the invention is concealed within the shank 14, the chemical can be effectively discharged by discrete motion of one finger without initially arousing the suspicions of an assailant. Moreover, where an action situation may quickly change so as to dictate the use of non-lethal means to subdue an assailant, a non-lethal chemical spray is immediately in hand for use.

The cannister 24 may contain several doses of any variety of chemicals known to repel or to temporarily disable an assailant. Chemical mace is a well-known trademarked substance which is commercially available in aerosol form. Another suitable substance is a 1% active solution of Alpha-chloroace tophenoene, 1,1,1, Trichlorethane, which is also commercially available.

A great advantage of the particular embodiments herein described is its ready adaptability to retrofit existing weapons with a minimum of modification. A kit, for example, might comprise a pair of wooden hand grips, a simple actuator, an aerosol cannister, a discharge tube and an appropriate nozzle. Alternatively the kit may exclude the hand grips, leaving to the kit user to make modifications, if any, to the stock hand grips. In a revolver the tube may be mountable within the butt end of the wooden hand grip so as to bypass the metal crosspiece at the butt end of the shank. Thus, the only modification to an existing firearm would amount to the replacement of the standard hand grips with hand grips including the operating mechanism of the chemical dispenser.

The invention has been described with respect to specific embodiments. Other embodiments will be suggested to those of ordinary skill in the art in light of this disclosure. For example, other types of firearms, such as rifles, might be modified to include a non-lethal chemical weapon concealed in either the butt grip or the barrel grip. Moreover, other actuating mechanisms might be employed. The cannister need not necessarily be of the aerosol type if a suitable discharge mechanism is employed.

In view of the foregoing detailed description of embodiments according to the present invention, it is not intended that this invention be limited except as indicated by the appended claims.

I claim:

1. A combination weapon comprising a pistol having a barrel and a shank with a butt end, a cylindrical cannister containing a pressurized debilitating chemical substance mounted in said shank, a valve for releasing said chemical substance, a digitally operable actuator for operating said valve, and a nozzle coupled to said cannister and mounted in the butt end of said shank transversely to the barrel for directing said chemical substance transverse to said barrel.

2. The combination weapon according to claim 1 wherein said actuator comprises a shaft having an externally-exposed button end, a shoulder, a tapered shank, and a guide end, said actuator being mountable laterally transverse of said shank, said shank including grip means having an external depression with a side aperture adapted to receive said button end, said button end being reciprocally movable between a first position and a second position, said actuator further including means for biasing said button end toward said first position in which said button end is laterally extended to a partially recessed level within said depression, said actuator being operative in said second position of said button end to release said valve.

3. The combination according to claim 2 wherein said grip means includes an internal trough disposed transverse to said barrel in general alignment with said nozzle for slidably supporting said cannister, said valve being operative to release said chemical upon unidirectional axial translation of said cannister within said trough, and said shank being operative to engage an end of said cannister of effecting said unidirectional translation.

4. A combination weapon according to claim 1 wherein said nozzle is separable from said cannister.

5. In a hand-carried firearm having a barrel and a generally hollow shank with a butt end, the improvement comprising a reservoir for containing a dispensable fluid repellant, said reservoir being adapted to be enclosed within said hollow shank, valve means for dispensing said repellant from said reservoir, a digitally-operable actuator which is accessible to a handgrip, and a nozzle in fluid communication with said reservoir, said nozzle being disposed transverse to said barrel for directing a discharge of said repellant from said firearm in an ostensibly non-aggressive direction.

6. The improvement according to claim 5 wherein said nozzle is disposed to dispense said fluid through said butt end.

7. The improvement according to claim 6 wherein said shank includes grip means with an external depression and wherein said actuator comprises a depressible button normally recessed within said depression for protection against inadvertent actuation and fluid discharge.

8. A kit for modifying a firearm to additionally discharge a disabling chemical, said firearm having a barrel and a generally hollow shank with a butt end with a pair of hand grips enclosing said hollow shank to form a cavity, said kit comprising a cannister adapted to fit within said cavity, valve means mounted to said cannister for releasing said chemical, actuator means for operating said valve means in response to digital compression of a firearm gripping hand, and a nozzle mountable in said butt end to direct a discharge of said chemical from said butt end in an ostensibly non-threatening and safe direction transverse of said barrel.

9. A kit for modifying a firearm to additionally discharge a disabling chemical, said firearm having a barrel and a generally hollow shank with a butt end, said kit comprising a pair of handle grips forming a cavity within said grip, at least one of said grip means including a lateral aperture, a cannister being adapted to fit within said cavity, valve means mounted to said cannister for releasing said chemical, means adapted to be accessible through said aperture for actuating said valve means in response to digital compression, and a nozzle mountable in said butt end to direct a discharge of said chemical from said butt end in a ostensibly non-threatening and safe direction transverse of said barrel.

* * * * *